US007063557B2

(12) United States Patent
Ziemke et al.

(10) Patent No.: US 7,063,557 B2
(45) Date of Patent: Jun. 20, 2006

(54) ELECTRICAL CONNECTOR WITH OPERATING MEANS

(75) Inventors: Jürgen Ziemke, Detmold (DE); Klaus Wohlgemuth, Bad Salzuflen (DE); Michaela Mücke, Detmold (DE); Rudolf Steinmeier, Detmold (DE); Volker Schröder, Lemgo (DE); Walter Hanning, Detmold (DE)

(73) Assignee: Weidmüller Interface GmbH & Co. KG, Detmold (DE)

( * ) Notice: Subject to any disclaimer, the term of this patent is extended or adjusted under 35 U.S.C. 154(b) by 0 days.

(21) Appl. No.: 11/102,762

(22) Filed: Apr. 11, 2005

(65) Prior Publication Data

US 2005/0245140 A1 Nov. 3, 2005

(30) Foreign Application Priority Data

Apr. 28, 2004 (DE) ..... 20 2004 006 806 U
Aug. 25, 2004 (DE) ..... 20 2004 013 363 U

(51) Int. Cl.
*H01R 11/20* (2006.01)

(52) U.S. Cl. ..... 439/417

(58) Field of Classification Search ..... 439/417, 439/409, 395, 391, 406
See application file for complete search history.

(56) References Cited

U.S. PATENT DOCUMENTS 5,622,517 A * 4/1997 Heng et al. ..... 439/417
6,120,315 A * 9/2000 Gaertner et al. ..... 439/395
6,478,605 B1 * 11/2002 Stuckmann et al. ..... 439/409
6,692,292 B1 * 2/2004 Huiskamp et al. ..... 439/417

FOREIGN PATENT DOCUMENTS

EP 936 697 A1 8/1999
EP 1191633 A2 3/2002
EP 1191634 A2 3/2002

* cited by examiner

*Primary Examiner*—Tulsidas C. Patel
*Assistant Examiner*—Phuongchi Nguyen
(74) *Attorney, Agent, or Firm*—Lawrence E. Laubscher, Sr.; Lawrence E. Laubscher, Jr.

(57) ABSTRACT

An electrical connector includes a connector body that contains an open-topped chamber in which is mounted a stationary, upwardly-directed insulation-severing electrical contact, together with an operating member for displacing an insulated conductor laterally downwardly in the chamber. The operating member includes a flexible intermediate portion that permits the leading end of the operating member to be introduced initially downwardly into the chamber, and subsequently to be diverted upwardly relative to the connector body by a guide surface arranged at the bottom of the chamber. As the leading and trailing ends of the operating member approach their final positions relative to the connector body, the insulation layer of the conductor is severed by knife edges on the stationary contact, and the conductor is brought into electrical engagement contact with the contact.

10 Claims, 3 Drawing Sheets

ELECTRICAL CONNECTOR WITH OPERATING MEANS

BACKGROUND OF THE INVENTION

This invention relates to an electrical connector including a connector body that contains an open-topped chamber in which is mounted a stationary upwardly directed insulation-severing electrical contact, together with operating means for displacing an insulated conductor laterally downwardly in the chamber, thereby to sever the insulation layer and produce electrical engagement between the bare conductor and the contact.

BRIEF DESCRIPTION OF THE RELATED ART

As shown by the European published patent applications Nos. EP 0 936 697 A1, EP 1 191 633 A2 and EP 1 191 634 A2, it is known in the prior art to provide electrical connectors with contact actuating pieces that are movable in a housing to effect electrical engagement and disengagement between an insulated conductor and a stationary contact. An actuation tool, such as a screwdriver, is applied in each case on mutually opposite sides of the contact actuation members in order to push the conductor into the IDC contact when connection is to be made, and to displace it out of engagement with that contact when disconnection takes place. The direction of movement of the screwdrivers during connection and disconnection thus is offset with respect to each other by 180°. This type of actuation has proved to be very effective, especially because of the strong connect and disconnect forces that can be produced on the conductor.

Nevertheless, in various practical applications, it is desirable to connect and disconnect also from other additional different directions (for instance, differing by 90°) or even out of that same direction due to special structural space conditions. According to the present invention, the contact actuation device has a flexible section that preferably is guided along a curved path, in particular, a housing that receives the connection device.

This measure facilitates the connection and disconnection from any desired direction and, in case of a deflection by 180°, even connection and disconnection from the same direction. This makes it possible to use insulation piercing contacts under particularly tight or special structural space conditions

SUMMARY OF THE INVENTION

Accordingly, a primary object of the present invention is to provide an improved electrical connector including an operating member for electrically connecting an insulated conductor with a stationary insulation-severing contact mounted in an open-topped chamber contained in the connector body.

According to a more specific object of the invention, the operating member includes a leading end section that is adapted for downward longitudinal insertion into the chamber, and a trailing end section that contains an opening for receiving a free end of the insulated conductor. The operating member includes a flexible section between the leading and trailing end sections, thereby to permit the leading end of the operating member to be diverted upwardly by guide means arranged adjacent the bottom of the chamber. As the leading end of the operating member approaches a final position relative to the connector body, the insulated conductor is laterally displaced downwardly by the trailing end of the operating member into insulation severing engagement with knife means on the stationary contact, thereby to effect electrical contact between the conductor and the stationary contact.

According to a further object of the invention, the free extremities of the leading and trailing ends of the operating member have planar surfaces that are adjacent and parallel when the leading end is in its final position, the end surfaces of the free extremities containing operating recesses for receiving the tip of an operating tool, such as a screwdriver. Thus, the advantage is presented that when a screwdriver tip is placed in the recess in the trailing end, the operating member may be laterally displaced with sufficient force to effect penetration of the insulation layer by the knife edges of the stationary contact. To disengage the conductor from the contact the screwdriver tip is inserted in the recess contained in the adjacent end extremity of the leading edge, whereupon the operating member is displaced in the opposite direction relative to the connector body. Thus, the screwdriver is displaced in the same axial direction to either connect or disconnect the conductor from the stationary contact.

The present invention is suitable for contacts of various types where a conductor is guided into the metal parts or contacts by means of an actuation device. In particular, it is suitable for insulation-penetrating contacts, such as IDC cutting contacts, but also for penetrating contacts. The connection devices can be used for plug connectors, terminal blocks and other electrical appliances. They are adapted to be inserted in this fashion into a housing made of insulation material, which housing displays the corresponding guide contour for the flexible section.

The flexible section can consist of the intermediate portion of a unitary band member that is in itself flexible. This band is preferably provided with a serrated side contour, thereby to afford the desired degree of flexibility. Use of a multilink chain is also conceivable. However, the one-piece version is favored because the latter facilitates deflection also in an extremely tight space and because one can nevertheless come up with a contact actuation device that can be produced in a particularly reasonably priced manner.

According to the present invention, the contact actuation device has a flexible section that preferably is guided along a curved path, in particular, a housing that receives the connection device. This measure facilitates the connection and disconnection from any desired directions and, in case of a deflection by 180°, even connection and disconnection from the same direction, something that makes it possible to use cutting contacts also under particularly tight or special structural space conditions.

BRIEF DESCRIPTION OF THE DRAWINGS

Other objects and advantages of the invention will become apparent from a study of the following specification when viewed in the light of the accompanying drawings, in which.

DETAILED DESCRIPTION OF THE INVENTION

Figure 1:
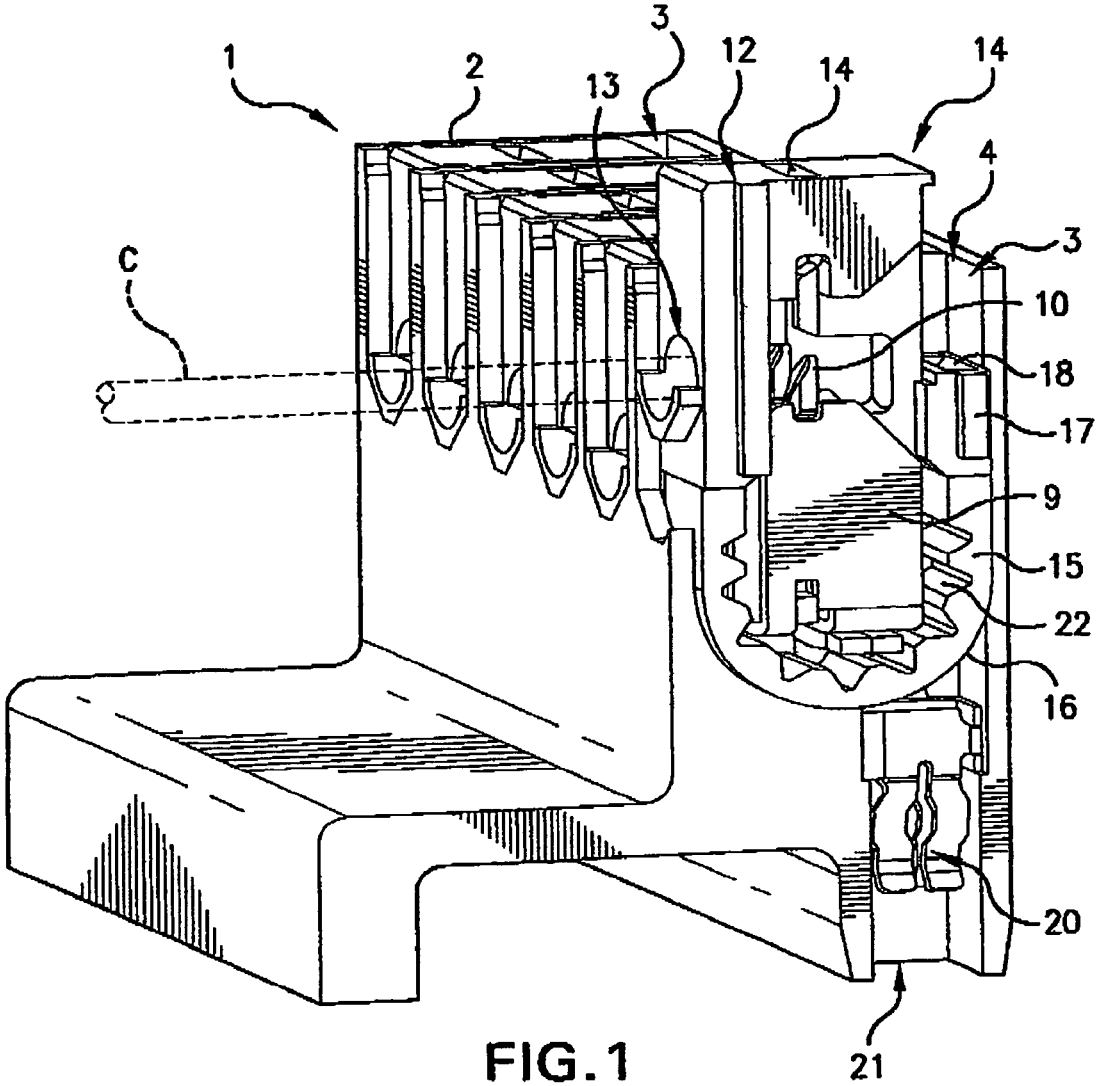
FIG. 1 is a front perspective view of the electrical connector apparatus of the present invention.

Referring first more particularly to FIG. 1, the electrical contact assembly of the present invention includes a connector body 2 formed of a suitable electrically insulating synthetic plastic material containing a plurality of open-topped chambers 3 in which are mounted a plurality of stationary electrical contacts 10, respectively. The front walls of the chambers contain vertical slots 3*a*, as will be described in greater detail below. In accordance with the present invention, a plurality of conductor operating devices 11 are provided for insertion into the chambers 3, respectively, thereby to displace a plurality of insulated conductors C laterally downwardly via the slots 3*a* into electrical engagement with the stationary insulation-severing contacts 10 mounted in the chambers, respectively.

Figure 2:
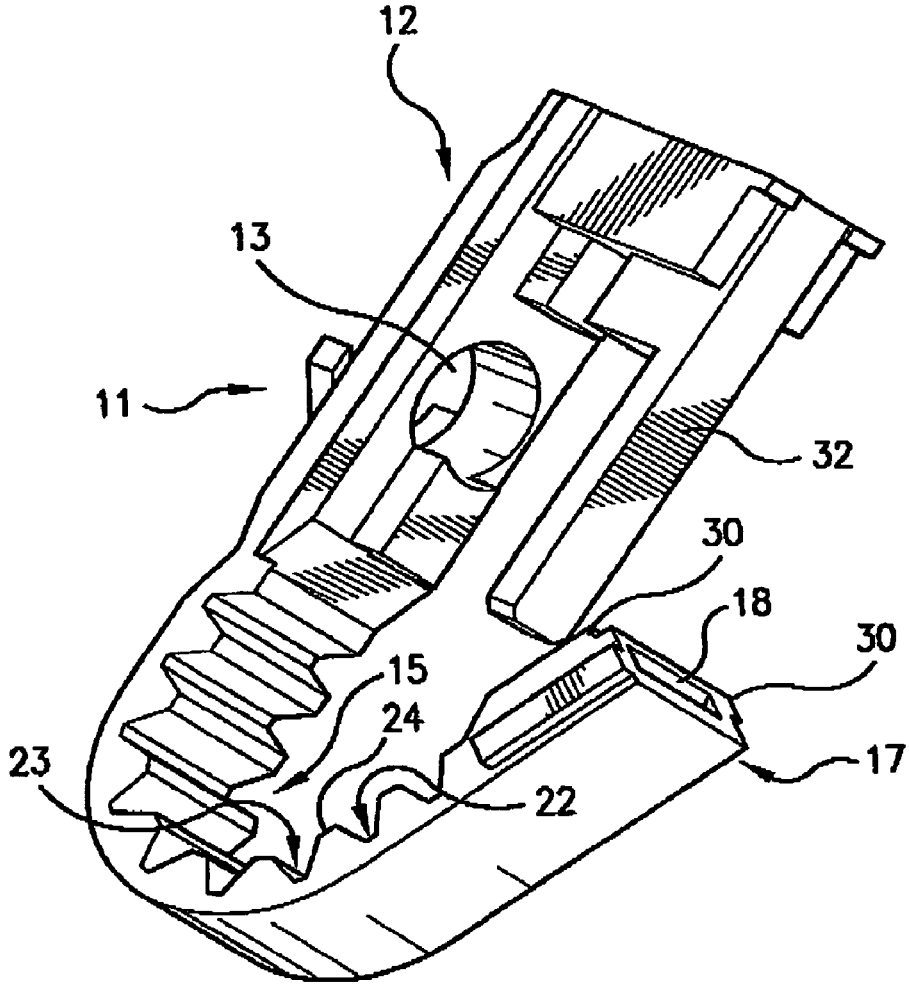
FIG. 2 is a front perspective view of the operating member of FIG. 1.

Referring now to FIG. 2, the conductor operating member 11 is a unitary member formed of an electrically insulating synthetic plastic material and includes a relatively rigid trailing end portion 12, a relatively rigid leading end portion 17, and a flexible intermediate portion 15. The trailing end portion 12 contains an opening 13 for receiving an insulated conductor C, and at its free end, the trailing end portion has an end surface that contains a tool-receiving recess 14. Similarly, the leading end portion 17 has at its free end an end surface that contains a tool-receiving recess 18. In order to increase its flexibility, the intermediate portion 15 of the operating member has a serrated longitudinal lateral surface 22 defined by a plurality of valleys 23 and peaks 24.

Figure 3C:
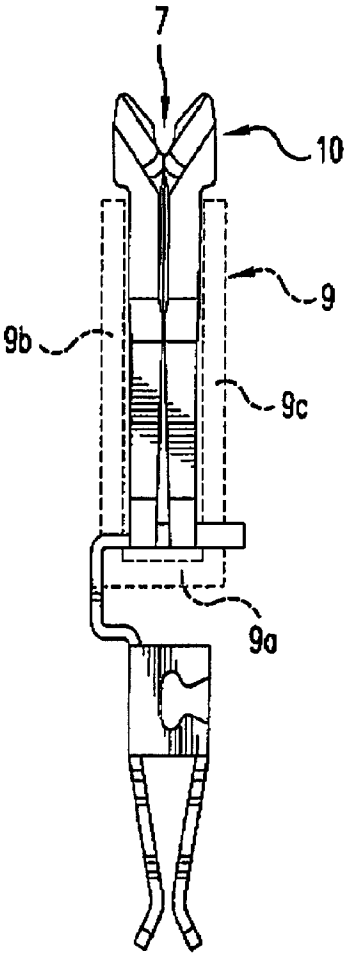
FIGS. 3*a*–3*c* are front, right side, and rear views, respectively, of the stationary insulation severing contact of FIG. 1.
Figure 3B:
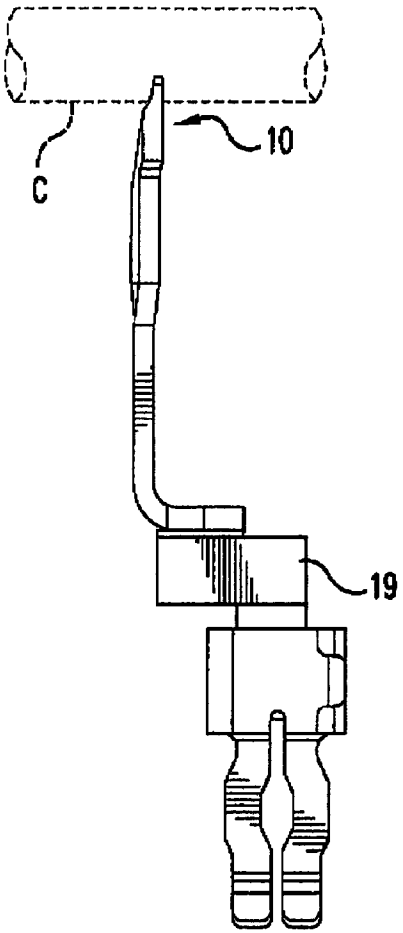
Figure 3A:
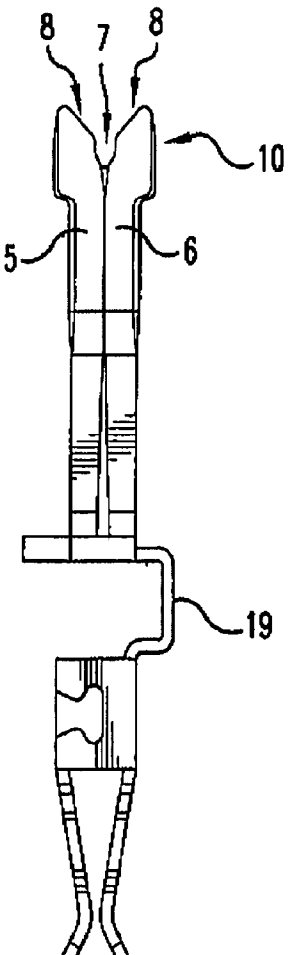

Referring now to FIGS. 3*a*–3*c*, the stationary electrical contact 10 includes a pair of spaced upwardly extending knife members 5,6 that terminate at their upper extremities in knife edges 8. The knife edges 8 are angularly arranged to define an insertion opening 7 for receiving a transversely arranged insulated conductor C, as illustrated in phantom in FIG. 3*b*. As shown in FIG. 3*c*, a U-shaped support spring 9 is provided having a transverse portion 9*a* that extends beneath the contact knives 5 and 6, and a pair of leg portions 9*b* and 9*c* that extend upwardly in supporting relation to, and on opposite sides of, the contact knives 5 and 6, respectively.

Referring again to FIG. 1, the leading portion 17 of the operating member 11 is adapted for downward insertion within a given chamber 3, thereby to displace laterally downwardly an insulated conductor C that has been inserted into the opening 13 contained in the trailing portion 12. The downward displacement of the operating member 11 is effected by the introduction of the tip of a displacing tool, such as a screwdriver, into the recess 14 contained in the free end of the trailing portion 12. During the progressive downward movement of the operating member, the leading end 17 thereof engages the semicircular guide surface 16 at the bottom of the chamber, wherein the direction of travel of the leading end 17 is reversed and directed upwardly in sliding engagement with the rear wall 4 of the chamber 3. The serrated lateral surface 22 assisted in the bending of the intermediate section 15 during the progressive insertion of the operating member into the chamber. During the downward movement of the trailing end portion 12 relative to the connector body, the conductor C mounted in the opening 13 is displaced laterally downwardly through a corresponding slot 3*a* contained in the front wall of the chamber 3. The conductor enters the opening 7 defined by the knife edges 8, whereupon the insulation layer of the conductor is severed by the knife edges 8, thereby to cause the knife edges to electrically engage the bare conductor. As the leading end 17 of the operating member 11 is displaced toward its final position, a guide rib 32 on the trailing portion 12 is brought into contiguous sliding engagement between the corresponding spaced guide shoulders 30 on the leading portion 17. Thus, the ends of the operating member are stabilized as the conductor C is displaced downwardly between the knives 5,6 of the stationary electrical contact against the biasing force exerted by the leg portions of the U-shaped spring 9. The conductor C can then be electrically connected to another component by means of the downwardly extending bell-shaped auxiliary contacts 20 of the contact 10, as is known in the art.

It is to be noted from FIG. 1 that the disconnect recess 18 on the leading portion 17 and the insertion connecting recess 14 on the trailing end portion 12 are adjacent for operation in the same axial direction by a screwdriver. Thus, to disconnect the conductor C from the stationary contact 10, the tip of a screwdriver is inserted into recess 18, and the axial force applied thereby to the leading end 17 causes the operating member to be displaced in the opposite direction to laterally displace the conductor C upwardly toward a disengaged position relative to the stationary contact 10.

It is apparent that the flexible section 15 can consist of an integral portion of a unitary body. The serrated surface 22 provides the appropriate degree of flexibility.

While in accordance with the provisions of the Patent Statutes the preferred forms and embodiments of the invention have been illustrated and described, it will be apparent to those skilled in the art that other modifications may be made deviating from the inventive concepts set forth above.

What is claimed is:

1. An electrical connector for connecting to an electrical contact an insulated conductor having a bare conductor, and a layer of insulation arranged concentrically about the bare conductor, comprising:

(a) a connector body (1) containing at least one open-topped chamber (3);

(b) a stationary electrical contact (10) mounted in said chamber, said contact including upwardly directed insulation severing means (8); and (c) operating means (11) for introducing the insulated conductor laterally into said chamber in insulation piercing relation with said insulation severing means, thereby to effect electrical engagement between said conductor and said contact, said operating means including an operating member having leading (17) and trailing (12) end portions, and a flexible section (15) intermediate said leading and trailing end portions, said leading portion adapted for progressive downward insertion into said chamber on one side of said stationary contact, said trailing portion containing an opening (13) for receiving the insulated conductor, said chamber including curved guide means (16) operable to deflect said leading end portion for continued travel in an upward direction on the opposite side of said stationary contact toward a final position relative to said connector body in which said trailing end portion causes the insulation layer of the conductor to be pierced by said insulation severing means.

2. An electrical connector as defined in claim 1, wherein said stationary contact includes additional downwardly directed second contact means (20) arranged for engagement by a conductor, and bus bar means (19) connecting said insulation-severing contact means with said second contact means.

3. An electrical connector as defined in claim 1, wherein said stationary insulation severing contact includes a pair of spaced upwardly extending conductive portions (5,6) that terminate at their upper ends in knife edges (8); and further including a U-shaped support spring (9) having a transverse portion extending beneath said contact conductive portions, and a pair of leg portions extending upwardly in supporting relation on opposite sides of said contact leg portions.

4. An electrical connector as defined in claim 1, wherein said connector body contains a plurality of said chambers; and further including a plurality of stationary insulation-severing electrical contacts mounted in said chambers, respectively, and a plurality of operating members for connecting a plurality of insulated conductors with said stationary contacts, respectively.

5. An electrical connector as defined in claim 1, wherein said operating member comprises a unitary body.

6. An electrical connector as defined in claim 5, wherein said chamber has a rear wall (4) that is arranged for sliding engagement by said leading end portion during the movement thereof toward said final position, and a front wall that contains a downwardly extending slot (3*a*) that receives the insulated conductor during the downward lateral transport thereof by said operating member trailing end portion.

7. An electrical connector as defined in claim 5, wherein said operating member flexible section includes a lateral surface (22) having a serrated longitudinal cross-sectional configuration.

8. An electrical connector as defined in claim 7, wherein said operating member trailing portion is contiguous with said leading portion when said leading portion is in said final position.

9. An electrical connector as defined in claim 8, wherein said leading and trailing end portions have adjacent parallel end surfaces when said lead end portion is in said final position, each of said end surfaces containing a recess (14; 18) operable to receive an activating tool for effecting insertion and removal of said operating member relative to said connector body, respectively.

10. An electrical connector as defined in claim 9, wherein said leading and trailing end potions are provided with cooperating longitudinal guide means (30; 32) that guide said end portions for relative axial displacement during the displacement of said leading end portion toward said final position relative to said connector body.

* * * * *